US009466409B2

(12) United States Patent
Eriksson et al.

(10) Patent No.: US 9,466,409 B2
(45) Date of Patent: Oct. 11, 2016

(54) ELECTRICAL INSULATION SYSTEM

(71) Applicant: ABB Schweiz AG, Baden (CH)

(72) Inventors: Anders Bo Eriksson, Ludvika (SE); Uno Gäfvert, Vasteras (SE); Josë-Luis Del Real, Ludvika (DE); Jan Hajek, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/892,112

(22) PCT Filed: May 19, 2014

(86) PCT No.: PCT/EP2014/060215

§ 371 (c)(1),
(2) Date: Nov. 18, 2015

(87) PCT Pub. No.: WO2014/187766

PCT Pub. Date: Nov. 27, 2014

(65) Prior Publication Data

US 2016/0093421 A1 Mar. 31, 2016

(30) Foreign Application Priority Data

May 21, 2013 (EP) ..... 13168556

(51) Int. Cl.
*H01F 27/28* (2006.01)
*H01B 17/56* (2006.01)
*H01F 27/32* (2006.01)

(52) U.S. Cl.
CPC ..... *H01B 17/56* (2013.01); *H01F 27/324* (2013.01); *H01F 27/325* (2013.01); *H01F 27/2871* (2013.01)

(58) Field of Classification Search
CPC ..... H01F 27/00–27/36
USPC ..... 336/55–62, 206–208, 210–215
See application file for complete search history.

(56) References Cited

U.S. PATENT DOCUMENTS 2,986,716 A 5/1961 Carlon
4,346,361 A * 8/1982 Sauer ..... H01F 27/322 336/60

(Continued)

FOREIGN PATENT DOCUMENTS

GB 191513586 A 10/1916
JP S61224302 A 10/1986

OTHER PUBLICATIONS

Extended European Search Report Application No. 13168556.2 Completed: Oct. 22, 2013; Mailing Date: Oct. 30, 2013 7 pages.

(Continued)

*Primary Examiner* — Tuyen Nguyen
(74) *Attorney, Agent, or Firm* — Whitmyer IP Group LLC

(57) ABSTRACT

An electrical insulation system for a high voltage inductive device includes a cylindrical insulation barrier defining an axial direction, a longitudinal bar having a main extension in the axial direction, the longitudinal bar arranged to support the cylindrical insulation barrier along the axial direction and to provide spacing in a radial direction, and the longitudinal bar having a first side facing the cylindrical insulation barrier and a second side, opposite the first side, having a groove, and a spacer having a main extension in the radial direction, the spacer being arranged to provide spacing in the axial direction, the spacer having a groove fitting end portion. The longitudinal bar is adapted to receive the groove fitting end portion of the spacer in the groove, and wherein the spacer is dimensioned so relative to the groove that the groove captures any streamer propagating from the spacer towards the cylindrical insulation barrier.

15 Claims, 4 Drawing Sheets

(56) References Cited

U.S. PATENT DOCUMENTS 4,523,169 A * 6/1985 Hay ..... H01F 27/085
336/192
5,455,551 A * 10/1995 Grimes ..... H01F 27/322
250/227.14

OTHER PUBLICATIONS

International Search Report and Written Opinion Application No. PCT/EP2014/060215 Completed: Jun. 23, 2014; Mailing Date: Jul. 17, 2014 4 pages.

* cited by examiner

ELECTRICAL INSULATION SYSTEM

FIELD OF THE INVENTION

The present disclosure generally relates to inductive devices. In particular it relates to an electrical insulation system for a high voltage inductive device.

BACKGROUND OF THE INVENTION

In oil insulated inductive devices, such as power transformers, mineral oil is typically used as an insulating fluid between inner parts subject to different electric potentials. The inner parts of an inductive device normally comprise a magnetic core, windings, and an electrical insulation system which provides insulation between parts having different electric potential. In particular, in the main duct of an inductive device a certain distance in oil should be kept to avoid dielectric breakdown during tests and service.

One typical solution of the insulation between windings in the main duct for core type designs implies the use of cylindrical barriers made of e.g. pressboard to divide oil spaces in the radial direction. This subdivision greatly improves the dielectric strength for the whole width of the main duct and it allows in practice to reduce its width significantly. The pressboard barriers are normally cylindrical and they are placed concentrically between the inner and outer winding in the main duct during the manufacturing of the inductive device. In order to support the barriers a set of longitudinal bars made of e.g. pressboard are placed evenly around the inner winding or the subsequent inner barriers.

The turns or discs in a winding can be arranged so that they are separated by pressboard spacers in the axial direction. These spacers provide space for electrical insulation as well as the flow of cooling oil. As they are placed evenly around the circumference of the winding, they are set in their positions by coupling to a corresponding longitudinal bar.

It has been identified that the oil regions delimited by winding conductor, winding spacer and longitudinal bar are heavily stressed under voltage conditions during tests and operation of an inductive device. In particular, during a lightning impulse stress, in these regions so called oil wedges can provide a point of initiation of an electrical flashover. In order for the flashover to be developed, a path for propagation must be formed and it must be connected to a surface of different potential. A streamer can propagate from the oil wedge across the oil space close to the wedge in the duct closest to the winding. A streamer can also propagate along the surface of the longitudinal bar until it reaches the cylindrical barrier and continue from that point along the barrier itself.

One example of an inductive device which has an insulation system that reduces the risk of flashovers is disclosed in GB191513586. The electrical transformer disclosed therein has windings composed of slab-like units, each made of insulated spirally wound flat wire. These units are separated by spacers which are interlocked at their ends with longitudinal spacer bars.

Existing electrical insulation systems do however not provided an adequate protection from streamers propagating from a spacer towards a cylindrical barrier.

SUMMARY OF THE INVENTION

In view of the above, an object of the present disclosure is to provide an electrical insulation system which reduces the risk of streamers initiated at a spacer reaching a cylindrical barrier.

Hence, according to a first aspect of the present disclosure there is provided an electrical insulation system for a high voltage inductive device, wherein the electrical insulation system comprises: a cylindrical insulation barrier defining an axial direction; a longitudinal bar having a main extension in the axial direction, the longitudinal bar being arranged to support the cylindrical insulation barrier along the axial direction and to provide spacing in a radial direction, and the longitudinal bar having a first side facing the cylindrical insulation barrier and a second side, opposite the first side, having a groove; and a spacer having a main extension in the radial direction, the spacer being arranged to provide spacing in the axial direction, the spacer having a groove fitting end portion, wherein the longitudinal bar is adapted to receive the groove fitting end portion of the spacer in the groove, and wherein the groove has a mouth, wherein the spacer has a largest width dimension which is smaller than the width of the mouth.

Thereby, any streamer propagating from the spacer may be captured in the groove. In particular, also streamers initiated anywhere along the lateral sides of the spacer will propagate into the groove. Once the streamer has entered and reached the bottom of the groove, it will not change direction, as the streamer will not travel against the radial electric field, nor will it prefer to move along the tangential direction, which is equipotential. The risk that a streamer initiated at the spacer will reach the cylindrical insulating barrier, and thus a lower electric potential surface, is therefore greatly reduced. As a result, the size of the main duct of the high voltage inductive device utilising the electrical insulation system may be compacted as higher electrical stress may be provided without electrical breakdown. Thereby a more compact high voltage inductive device may be provided.

According to one embodiment the second side of the longitudinal bar has an end face which defines a first plane, and wherein each surface of the spacer immediately following the groove fitting end portion, in a direction towards a central portion of the spacer, defines a plane which intersects the first plane.

According to one embodiment the extension of the groove in the axial direction is greater than the thickness of the spacer. Thereby, spacers originating along any surface of the spacer may be guided into the groove of the longitudinal bar.

According to one embodiment the second side of the longitudinal bar has an end portion at each side of the groove arranged to abut a winding. The groove fitting end portion of the spacer is thereby laterally enclosed by the groove such that any streamer initiated at the spacer may be guided, without the risk of escaping, into the groove.

According to one embodiment the spacer has a body comprising a central portion and the groove fitting end portion, and wherein the groove fitting end portion has a tapering portion tapering in a direction from the central portion to the groove fitting end portion such that the width of the tapering portion becomes narrower the farther away from the central portion.

According to one embodiment the groove has a tapering portion in level with the tapering portion of the groove fitting end portion, wherein the tapering portion of the groove is tapering in a direction from the second side of the longitudinal bar towards the first side of the longitudinal bar.

According to one embodiment the tapering portion of the groove and the tapering portion of the groove fitting end portion are tapering with different angles such that a space is formed between each lateral side of the groove fitting end portion and the tapering portion of the groove. It is thereby rendered more difficult for a streamer to "jump" from the lateral side of the spacer to the outer side of the longitudinal bar at the end face of the second side of the longitudinal bar.

According to one embodiment the longitudinal bar is made of a plastic material. The longitudinal bar may thereby be manufactured by means of extrusion, for example, rendering it simpler to manufacture a single piece longitudinal bar. By providing a single piece longitudinal bar, glue joints which give rise to open streamer paths, may be avoided.

According to one embodiment the longitudinal bar is manufactured of a single piece of material.

According to one embodiment the longitudinal bar has a first lateral side and a second lateral side, each of the first lateral side and the second lateral side extending between the first side and the second side, wherein each lateral side is provided with ribs. The propagation distance of streamers can by means of the ribs be extended, rendering it more difficult for a streamer to reach the cylindrical insulation barrier along the longitudinal bar.

According to one embodiment at least some ribs are perpendicular relative to the lateral side.

According to one embodiment at least some of the ribs have an acute angle with a lateral side of the longitudinal bar, the acute angle between each of the at least some of the ribs and the lateral side being formed in the direction from the second side towards the first side.

The electrical insulation system presented herein may beneficially be used in a high voltage inductive device, such as a power transformer or a reactor. Hence, according to a second aspect of the present disclosure, there is provided a high voltage inductive device comprising the electrical insulation system according to the first aspect.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION OF THE INVENTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1A:
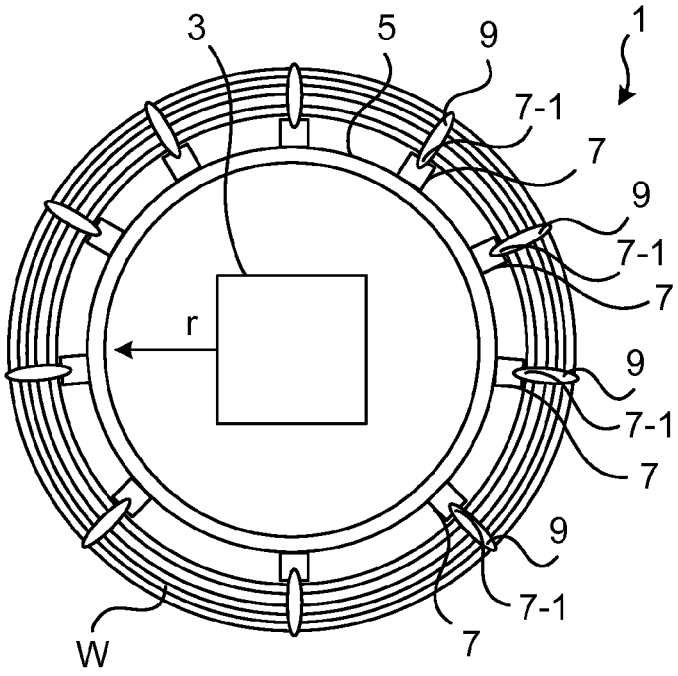
FIG. 1*a* is a schematic top view of an electrical insulation system, windings and a magnetic core of a high voltage inductive device.
Figure 1B:
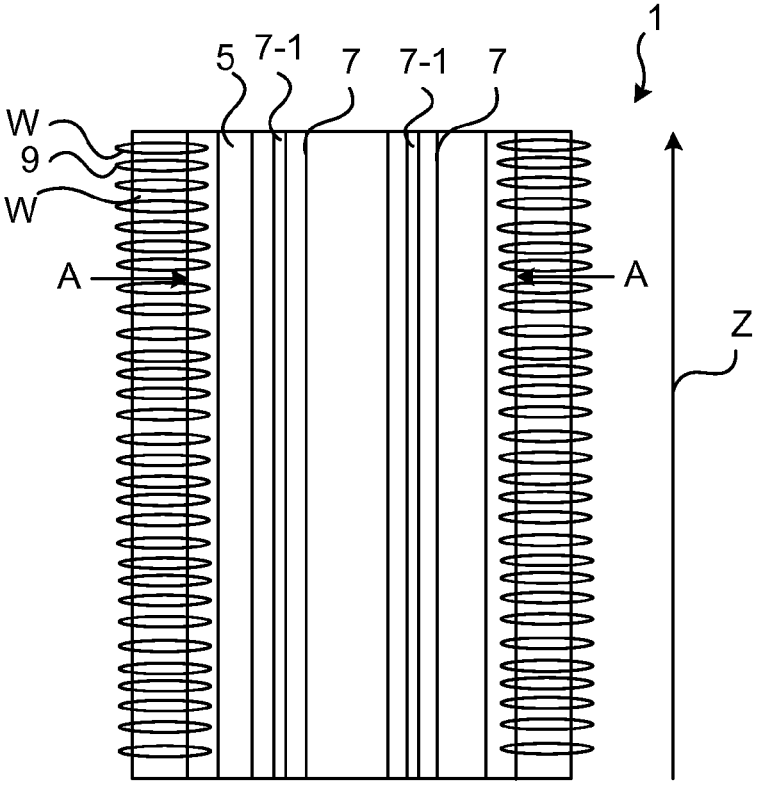
FIG. 1*b* is a schematic side view, with part of the windings cut away to expose the cylindrical insulation barrier and longitudinal bars, of the electrical insulation system in FIG. 1*a;*

FIG. 1*a* depicts an electrical insulation system 1 arranged around a magnetic core 3 of a high voltage inductive device. The electrical insulation system 1 comprises a cylindrical insulation barrier 5 which is to be arranged radially outwards relative to the magnetic core 3, as shown in FIG. 1*a*. In other words, the cylindrical insulation barrier 5 is arranged outside the magnetic core 3, in the radial direction r, and the cylindrical insulation barrier 5 encloses the magnetic core 3 in the axial direction Z defined by the direction of longitudinal extension of the cylindrical insulation barrier 5, as shown in FIG. 1*b*. The electrical insulation system 3 further comprises a plurality of longitudinal bars, also known as sticks, 7 arranged around the circumference of the cylindrical insulation barrier 5 for supporting the cylindrical insulation barrier 5, and a plurality of spacers 9 extending in the radial direction r from a respective longitudinal bar 7. The spacers 9 are arranged to provide spacing in the axial direction Z, between winding layers of windings w, as shown in FIG. 2*a*. Each spacer 9 has a groove fitting end portion which is arranged to be received by a corresponding groove of a longitudinal bar 7, as will be described in more detail in the following.

It is to be noted that the cylindrical insulation barrier according to the present disclosure may be arranged at either side of the winding w, i.e. both radially inside the winding as shown in FIG. 1*a*, or radially outside the winding. Moreover, either longitudinal end of the spacers may have a groove fitting end portion arranged to be received in a groove of a longitudinal bar.

FIG. 1*b* depicts a schematic side view of the electrical insulation system 1 in FIG. 1*a*, with part of the windings w and spacers 9 cut away so as to expose the cylindrical insulation barrier 5 and the longitudinal bars 7. The longitudinal bars 7 have a main extension in the axial direction Z, i.e. the largest dimension of each longitudinal bar 7 is in the axial direction Z when mounted to the cylindrical insulation barrier 5. Each longitudinal bar 7 has a main extension which corresponds to, or essentially corresponds to, the longitudinal extension or height of the cylindrical insulation barrier 5. Furthermore, according to one variation of the electrical insulation system 1, each longitudinal bar 7 has a groove 7-1 that runs along the longitudinal bar 7 along the entire main extension thereof, or at least along the majority of the main extension. Thus, each groove 7-1 has a main extension in the axial direction Z when the longitudinal bars 7 are mounted to the cylindrical insulation barrier 5. Alternatively, each longitudinal bar could comprise a plurality of grooves or cut-outs along the axial direction thereof, each groove or cut-out being associated with a respective spacer in the axial direction.

Figure 2:
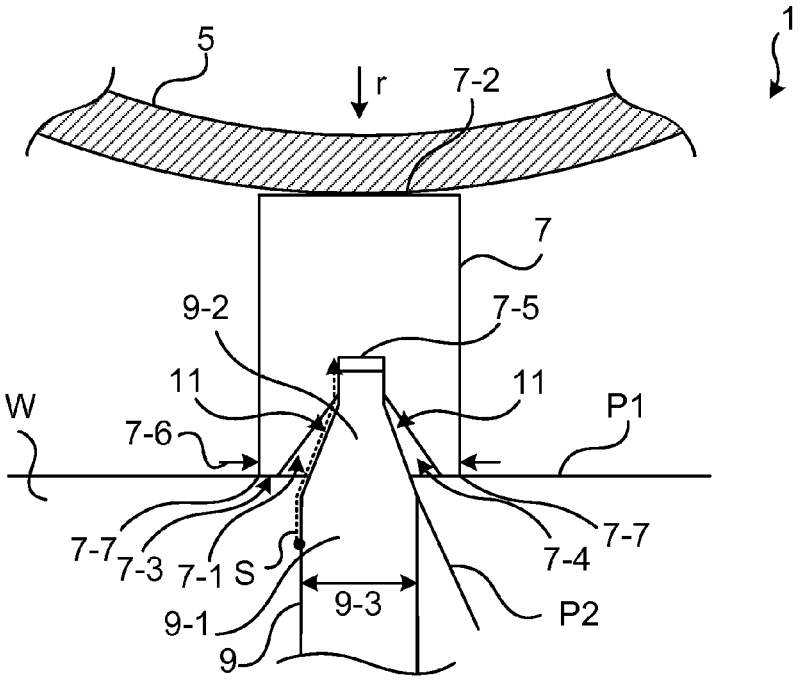
FIG. 2 shows part of a cross section of one example of an electrical insulation system in FIG. 1*b* along section A-A.
Figure 3A:
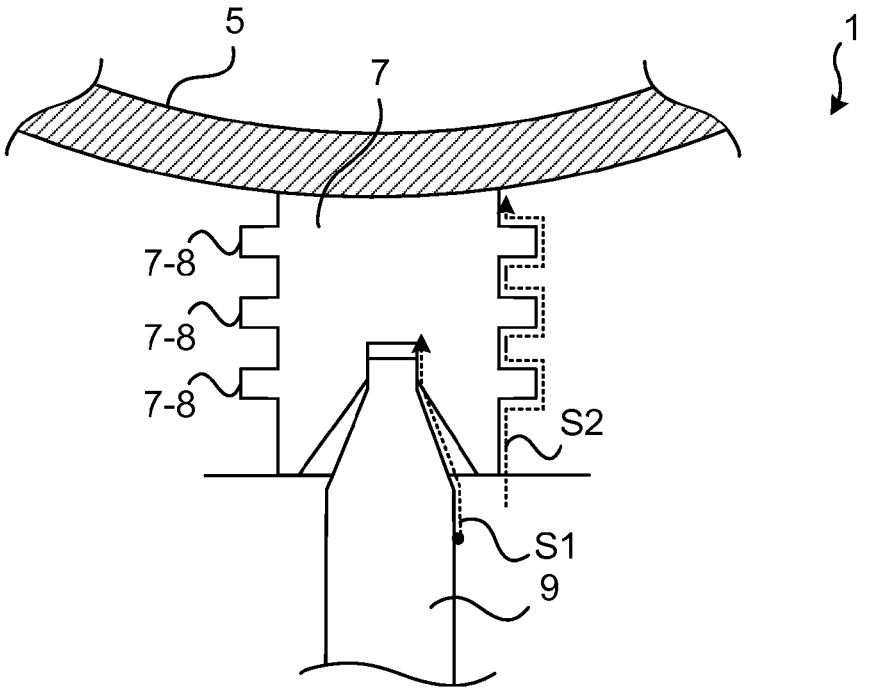
FIG. 3*a* shows part of a cross section of another example of an electrical insulation system in FIG. 1*b* along section A-A.
Figure 3B:
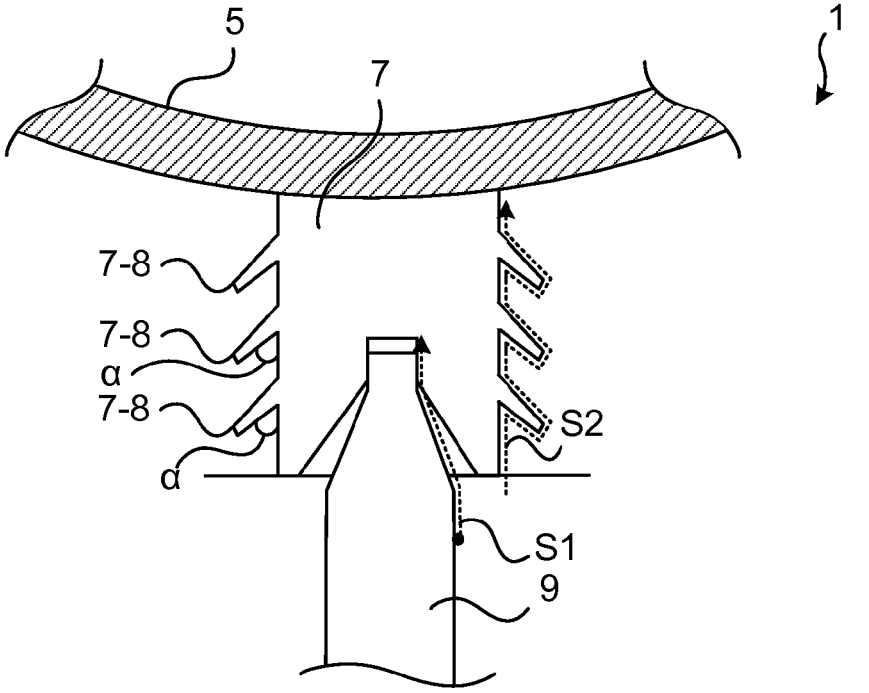
FIG. 3*b* shows part of a cross section of one example of an electrical insulation system in FIG. 1*b* along section A-A.
Figure 4:
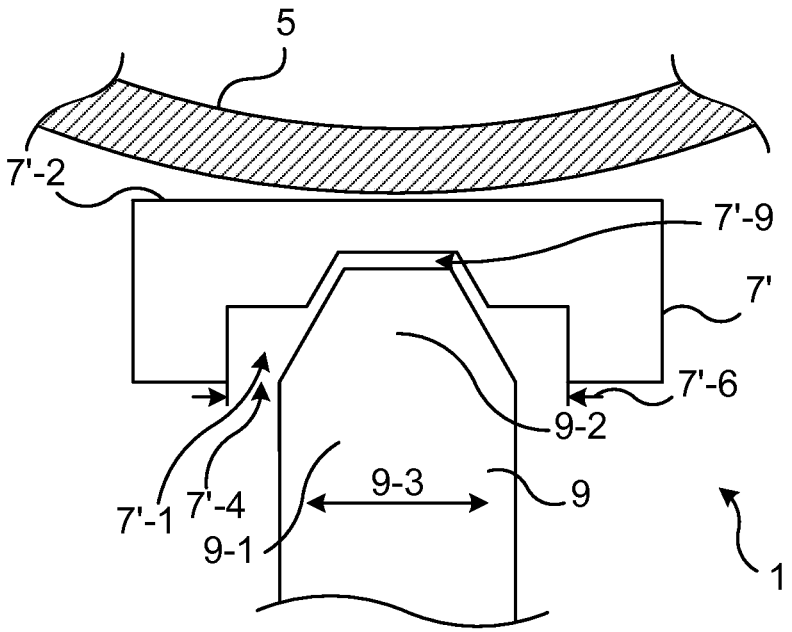
FIG. 4 depicts a similar view as the example in FIG. 2 of another example of an electrical insulation system.

With reference to FIGS. 2-4, several variations of the electrical insulation system 1 will now be described in more detail. FIG. 2 shows a portion of a cross section of an example of an electrical insulation system 1 along section A-A in FIG. 1*b*. The electrical insulation system 1 comprises a cylindrical insulation barrier 5, a longitudinal bar 7, and a spacer 9 having a main extension in the radial direction r and comprising a body having a central portion 9-1 and a groove fitting end portion 9-2. The longitudinal bar 7 has a first side 7-2 arranged to face the cylindrical insulation barrier 5, and a second side 7-3, opposite the first side 7-2, having a groove 7-1. The groove 7-1 is arranged to receive the groove fitting end portion 9-2 of the spacer 9. The groove fitting end portion 9-2 of the spacer 9 is adapted to be received in the groove 7-1, and to engage or interlock therewith. The longitudinal bar 7 and the spacer 9 are thus aligned in the radial direction r.

According to the example in FIG. 2, the groove fitting end portion 9-2 of the spacer 9 has a tapering portion tapering in a direction from the central portion 9-1 to the groove fitting end portion 9-2. The width of the tapering portion thus becomes narrower the farther away from the central portion 9-1. Other geometrical shapes are also contemplated; the groove fitting end portion could for example be rectangular, or tapering in the opposite direction from the end face towards the central portion.

The groove 7-1 has a mouth 7-4 and a bottom 7-5 presenting a bottom surface of the groove 7-1. According to the example in FIG. 2, the groove 7-1 is tapering in level with the tapering portion of the spacer 9 when the tapering portion of the spacer 9 is arranged in the groove 7-1, in a direction from the second side 7-3 towards the first side 7-2, i.e. in a direction from the mouth 7-4 towards the bottom 7-5. The mouth 7-4 thus has a width 7-6 which is greater than the width of the bottom 7-5. At both lateral sides of the mouth 7-4 the longitudinal bar 7 has a respective end portion 7-7 having a respective end face arranged to abut the windings w at a respective side of the spacer 9. The longitudinal bar 7 thus laterally encloses the spacer 9 by means of the groove 7-1 and the end portions 7-7 as the spacer 9 extends radially from the winding w.

According to the example in FIG. 2, the tapering portion of the groove 7-1 and the tapering portion of the groove fitting end portion 9-2 are tapering with different angles such that a space 11 is formed between each lateral side of the groove fitting end portion 9-2 and the tapering portion of the groove 7-1. Other designs are however also contemplated; the lateral sides of the groove fitting end portion could for example be parallel with and distanced from the inner side surfaces of the groove.

The spacer 9 is dimensioned so relative to the groove 7-1 that the groove 7-1 captures any streamer S propagating from the spacer 9 towards the cylindrical insulation barrier 5. This may be achieved by dimensioning the spacer 9 and the longitudinal bar 7 such that the largest width of the spacer 9 at the interface between the spacer 9 and the longitudinal bar 7, i.e. a portion or longitudinal section of the spacer 9 which includes the transition of the groove fitting end portion 9-2 into the central portion 9-1 of the spacer 9, is smaller than the width of the mouth 7-4 of the groove 7-1, and by dimensioning the extension of the groove 7-1 in the axial direction Z to be greater than the thickness of the spacer 9, i.e. its extension in the axial direction Z. The second side 7-3 of the longitudinal bar 7 may have an end face which defines a first plane P1 parallel with the first side 7-2, and each surface of the spacer 9 immediately following the groove fitting end portion 9-2, in a direction towards the central portion 9-1 of the spacer 9, defines a plane P2 which intersects the first plane P1. For clarity, only one such plane P2 is shown in FIG. 2. Thereby, essentially any streamer initiated at any side of the spacer 9 and propagating radially in the direction of the electric field will be caught in the groove 7-1. Once the streamer has reached the bottom surface of the bottom 7-5, it would never propagate in a direction against the electric field and thus the risk of flashovers may be reduced.

An example of the above-described design is illustrated in FIG. 2, where the greatest width dimension 9-3 of the spacer 9 is smaller than the width 7-6 of the mouth 7-4 of the groove 7-1, whereby the effect of capturing essentially any streamer propagating from the spacer 9 may be achieved. However, a plurality of other designs are possible; the body of the spacer following the groove fitting end portion may gradually become wider in a direction towards the central portion. Furthermore, the spacer could widen in one or more discontinuous steps at a suitable safe distance from the end face of the second side of the longitudinal bar.

The bottom surface of the groove 7-1 may be plane and parallel with the first side 7-2. The end face of the groove fitting end portion 9-2 may be plane and parallel with the bottom surface of the groove 7-1 when arranged in the groove 7-1. The end face of the groove fitting end portion 9-2 and the bottom surface of the groove 7-1 are according to this variation distanced from each other, whereby a space is formed therebetween.

The groove 7-1 may according to one variation have a depth which at most corresponds to about half the distance between the first side 7-2 and the second side 7-3 of the longitudinal bar 7. According to another variation, the groove may have a depth which at most corresponds to 75% or about 75% of the distance between the first side and the second side of the longitudinal bar. Streamers accelerate continuously, and high speed streamers are very destructive. By limiting the depth of the groove 7-1, the speed of streamers may be restricted.

An example of a streamer S initiated at the spacer 9 can be seen in FIG. 2. The streamer S propagates along the spacer 9 through a dielectric medium which surrounds the electric insulation system 1, e.g. a mineral oil until it is captured in the groove 7-1.

FIG. 3*a* shows another example of an electrical insulation system 1. The electrical insulation 1 in FIG. 3*a* is similar to that described with reference to FIG. 2. The longitudinal bar 7 of FIG. 3*a* however comprises ribs 7-8 arranged on a first lateral side and a second lateral side extending between the first side 7-2 and the second side 7-3 of the longitudinal bar 7. The ribs 7-8, which protrude in the tangential direction, may extend along essentially the entire length of the longitudinal bar 7 along the main extension thereof. The ribs 7-8 are preferably integrated with the main body of the longitudinal bar 7, such that no glue joints are provided which could open paths for streamers.

All the ribs 7-8, or alternatively some of the ribs 7-8, may extend perpendicularly relative to the first lateral side and the second lateral side of the longitudinal bar 7. The propagation distance of streamers can by means of the ribs 7-8 be extended, rendering it more difficult for a streamer to reach the cylindrical insulation barrier 5 along the longitudinal bar 7. Streamers S1 initiated at the spacer 9 may hence be captured in the groove 7-1, and streamers S2 propagating in the vicinity of the spacer 9 and the longitudinal bar 7 may propagate along the extended length of the lateral side of the longitudinal bar 7, reducing the risk that a streamer reaches the cylindrical insulating barrier 5.

FIG. 3*b* shows another example of an electrical insulation system 1. The electrical insulation 1 in FIG. 3*b* is similar to that described with reference to FIG. 3*a*. The longitudinal bar 7 of FIG. 3*b* however comprises ribs 7-8 that have an acute angle $\alpha$ with a lateral side of the longitudinal bar 7. The acute angle $\alpha$ between each rib 7-8 and the lateral side of the longitudinal bar 7 is formed in the direction from the second side 7-3 towards the first side 7-2. According to a variation of the example in FIG. 3*b*, some of the ribs may have an acute angle with the lateral side or lateral sides of the longitudinal bar, and some of the ribs may have perpendicular angle with the lateral side. A combination of different types of ribs is thus also envisaged.

FIG. 4 depicts yet another example of an electrical insulation system 1. The electrical insulation system 1 is similar to the electrical insulation system described in FIG. 2, but differs in that longitudinal bar 7' has a groove 7'-1 that has a cross-sectional shape which differs from what has previously been described. The groove 7'-1 has a mouth 7'-4 leading in to a first depth level of the groove 7'-1. The groove 7'-1 further has a recess or cavity 7'-9 which is adapted to receive the groove fitting end portion 9-2 of the spacer 9. The recess or cavity 7'-9 provides a second depth level of the groove 7'-1, and which recess or cavity has a mouth which is narrower than the mouth 7'-4 of the groove 7'-1. The width 9-3 of spacer 9, especially the width of the central portion 9-1, is thus less than the width 7'-6 of the mouth 7'-4 of the groove 7'-1. The recess or cavity 7'-9 is according to the example in FIG. 4 centred in the groove 7'-1, and the cross section of the groove 7'-1 is hence symmetrical. Any streamer arising at the spacer 9 and propagating towards the cylindrical insulation barrier 5 would thereby be caught in the groove 7'-1. It should be noted that a plurality of variations of the cross-sectional shape of the groove is possible in order to obtain a groove which captures the streamers arising at and propagating from the spacer. Generally, the width of the groove should be greater than the width, i.e. corresponding dimension, of the spacer.

The cylindrical insulation barrier can for example be made of a cellulose material such as pressboard. The longitudinal bars and spacers according to any variation presented herein may for example be manufactured of a cellulose material, such as pressboard, or a plastic such as Polyetherimide, Polyphenylene Sulphide, Polyetheretherketone, Polyethersulphone, Polysulphone, Polyphtalamide, or Polyethylene terephthalate. In particular, it is advantageous to manufacture each longitudinal bar as a single piece entity, i.e. of full cross section such that each longitudinal bar is a solid block without glue joints. The groove can thus be formed by machining or by an extrusion process.

It is envisaged that the electrical insulation system presented herein finds applications within AC and HVDC power transmission both onshore and offshore. In particular, the electrical insulation system may be utilised in HVDC or AC inductive devices such as power transformers and reactors.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An electrical insulation system for a high voltage inductive device, wherein the electrical insulation system comprises:

a cylindrical insulation barrier defining an axial direction, a longitudinal bar having a main extension in the axial direction, the longitudinal bar being arranged to support the cylindrical insulation barrier along the axial direction and to provide spacing in a radial direction, and the longitudinal bar having a first side facing the cylindrical insulation barrier and a second side, opposite the first side, having a groove, and a spacer having a main extension in the radial direction, the spacer being arranged to provide spacing in the axial direction, the spacer having a groove fitting end portion, wherein the longitudinal bar is adapted to receive the groove fitting end portion of the spacer in the groove, and wherein the groove has a mouth, wherein the spacer has a largest width dimension which is smaller than the width of the mouth.

2. The electrical insulation system claimed in claim 1, wherein the second side of the longitudinal bar has an end face which defines a first plane, and wherein each surface of the spacer immediately following the groove fitting end portion, in a direction towards a central portion of the spacer, defines a plane which intersects the first plane.

3. The electrical insulation system as claimed in claim 1, wherein the extension of the groove in the axial direction is greater than the thickness of the spacer.

4. The electrical insulation system as claimed in claim 1, wherein the second side of the longitudinal bar has an end portion at each side of the groove arranged to abut a winding.

5. The electrical insulation system as claimed in claim 1, wherein the spacer has a body comprising a central portion and the groove fitting end portion, and wherein the groove fitting end portion has a tapering portion tapering in a direction from the central portion to the groove fitting end portion such that the width of the tapering portion becomes narrower the farther away from the central portion.

6. The electrical insulation system as claimed in claim 1, wherein the groove has a tapering portion in level with the tapering portion of the groove fitting end portion, wherein the tapering portion of the groove is tapering in a direction from the second side of the longitudinal bar towards the first sided of the longitudinal bar.

7. The electrical insulation system as claimed in claim 6, wherein the tapering portion of the groove and the tapering portion of the groove fitting end portion are tapering with different angles such that a space is formed between each lateral side of the groove fitting end portion and the tapering portion of the groove.

8. The electrical insulation system as claimed in claim 1, wherein the longitudinal bar is made of a plastic material.

9. The electrical insulation system as claimed in claim 1, wherein the longitudinal bar is manufactured of a single piece of material.

10. The electrical insulation system as claimed in claim 1, wherein the longitudinal bar has a first lateral side and a second lateral side, each of the first lateral side and the second lateral side extending between the first side and the second side, wherein each lateral side is provided with ribs.

11. The electrical insulation system as claimed in claim 10, wherein at least some ribs are perpendicular relative to the lateral side.

12. The electrical insulation system as claimed in claim 10, wherein at least some of the ribs have an acute angle with a lateral side of the longitudinal bar, the acute angle between each of the at least some of the ribs and the lateral side being formed in the direction from the second side towards the first side.

13. A high voltage inductive device comprising an electrical insulation system as claimed in claim 1.

14. The high voltage inductive device as claimed in claim 13, wherein the high voltage inductive device is a power transformer.

15. The high voltage inductive device as claimed in claim 13, wherein the high voltage inductive device is a reactor.

* * * * *